United States Patent [19]

Faid

[11] 4,059,935

[45] Nov. 29, 1977

[54] POST-APPLIED WATERSTOP

[75] Inventor: Robert W. Faid, Westford, Mass.

[73] Assignee: W. R. Grace & Co., Cambridge, Mass.

[21] Appl. No.: 693,507

[22] Filed: June 7, 1976

[51] Int. Cl.[2] ..... E04B 1/68; E01C 11/02

[52] U.S. Cl. ..... 52/396; 264/35; 404/68; 52/573; 52/732

[58] Field of Search ..... 404/47, 64, 74, 65–70, 404/72; 52/573, 698, 699, 396; 264/35

[56] References Cited

U.S. PATENT DOCUMENTS

| | | | |
|---|---|---|---|
| 1,965,601 | 7/1934 | Kotrbaty | 52/573 |
| 2,039,420 | 5/1936 | Isett | 404/74 |
| 2,119,586 | 7/1938 | Kotrbaty | 52/573 |
| 2,858,695 | 11/1958 | Loughborough | 52/698 |
| 2,961,731 | 11/1960 | Buzzell et al. | 404/64 |
| 3,497,579 | 2/1970 | Barron | 264/33 |
| 3,981,601 | 9/1976 | Arai | 404/68 |

FOREIGN PATENT DOCUMENTS

| | | | |
|---|---|---|---|
| 1,235,974 | 3/1967 | Germany | 404/64 |
| 2,349,102 | 4/1975 | Germany | 52/573 |
| 410,034 | 10/1966 | Switzerland | 404/64 |
| 422,033 | 10/1966 | Switzerland | 404/47 |
| 956,706 | 4/1964 | United Kingdom | 52/396 |

OTHER PUBLICATIONS

E. A. Allen & E. C. Higginson, Waterstops In Articulated Concrete Construction, Journal of American Concrete Institute, 1952, pp. 86–91.

*Primary Examiner*—James L. Ridgill, Jr.

*Attorney, Agent, or Firm*—William L. Baker; C. Edward Parker

[57] ABSTRACT

Waterstop for use in jump or slip casting of concrete comprising two strips of T-shaped transverse cross-section which can be fastened together by means of bars and bolts after the first strip has been embedded at the edge of a concrete mass. After fastening the second strip to the first, the second mass of concrete is poured to embed said second strip.

12 Claims, 11 Drawing Figures

POST-APPLIED WATERSTOP

THE PRIOR ART

The present invention provides improvements in the construction of concrete structures such as containment buildings for nuclear power plants. These and other large concrete structures are customarily built in sections provided with expansion joints between the sections to accomodate expansion on contraction resulting from thermal changes.

In the erection of said structures, the sections of concrete are produced by pouring liquid concrete into wooden forms which are removed once the concrete has hardened. The erection and dismantling of these wooden forms, before and after the pouring of each concrete section, entails the expenditure of large quantities of labor and time. In many types of structures, it is necessary to provide each expansion joint with means to prevent the passage of water and other fluids through the joints. These means, designated as waterstops, bridge the joints and are retained in place by being embedded in the concrete of adjacent sections.

A common type of waterstop consists of a strip of resilient material which, when viewed in cross-section, is essentially dumbell-shaped in that it comprises bulbous longitudinal extremities interconnected by a parallel-sided web. The bulbous sides extend along the entire length of the waterstop and form anchoring means for the waterstop in the concrete of the structure. The parallel-sided web portions then spans the expansion joints between the sections and blocks the passage of fluids through the joints.

Resilient waterstop of this bulb type have proved to be quite satisfactory in service but unfortunately, their installation has been cumbersome and costly. The conventional practice calls for embedding one of the bulbous sides of the waterstop in the first pour of concrete, with a portion of the web and the opposite bulbous side projecting from the face of the first pour. This protrusion makes it necessary either to split the mold form used for the first pour, or alternatively, to provide a recess in the form to accomodate it. In either case, the procedure is expensive and time-consuming. Furthermore, it does not permit recourse to the economical tecnhiques of slip or jump casting which eliminate the conventional dismantling and reassembling of the mold forms required.

Improvements in waterstop design have heretofore been disclosed which overcome part of the handicaps of dumbell-shaped sealing strips by allowing the use of slip or joint concrete casting techniques in conjunction with the installation of waterstop. These approaches are disclosed in U.S. Pat. No. 2,858,695 and U.S. reissue Pat. No. 25,102, original U.S. Pat. No. 2,961,731. These inventions are based on the principle that the section of web and bulbous side that would protrude beyond the mold plane under normal practice is folded towards the section of strip to be embedded into the first pour to an extent where it forms a 90° angle with the section to be embedded. The folded strip is held in place, prior to pouring, by various means including nails or special clips. After the first pour has become solid, the form is removed from the face of the concrete and the folded portion of the strip allowed to become straight once more, in position for engaging the second pour. As shown in U.S. Re. Pat. No. 25,102, the portion of the sealing strip to be folded may be split in two through the bulb and web part, or as shown in U.S. Pat. No. 2,858,695, the cross-section of the entire strips may be Y-shaped — with one leg of the Y being embedded in the first pour. In both these cases, the two ends of the strip to be free from the first pour are folded back upon the third unslit section to form 90° angles with the latter. The resulting seal arrangement is then treated in the manner just described for the folded-back unslit dumbbell-shaped sealing strip.

A serious shortcoming of these otherwise useful foldable sealing strips is that they cannot be used in constructions that require continuous waterstop going in different directions. Thus, for instance, it may be necessary for the sealing strip to be installed along the plane of the first pour surface either to change direction to the left or to the right or to branch out in both these directions while possible continuing in the original direction as well. Thus, the sealing strip may have to form a right-angle elbow, a T-joint or a cruciform joint. The tridimensionality of the part of the conventional strip that is to project from the first pour makes such changes of direction impossible, if the integrity of the finally installed sealing strip is to be achieved.

SUMMARY OF THE INVENTION

The waterstop of the present invention consists essentially of two sealing strips of resilient material, each strip having a T-shaped cross-section. Installation between two concrete masses comprises a first embodiment of one of the sealing strips in the first concrete placement in a manner such that said strip does not protrude beyond the face of the form used to mold the concrete mass. The second strip is then fastened to the embedded strip, after which the second concrete placement is made.

DETAILED DESCRIPTION

This invention enables waterstop to be placed between concrete masses where it has heretofore been impossible or impractical to embed conventional waterstop. The system is especially suited for use with slip forming or jump forming of concrete structure, methods in which the forms employed to mold the masses of concrete are moved on, gradually or intermittenly as one pour of concrete solidifies, so that further concrete can be poured without the use of additional forms.

This continuous concrete casting system is made possible by the use of a novel two-strip waterstop which, along with its method of use, can be best understood by referring to the accompanying drawings in which.

Figure 1:
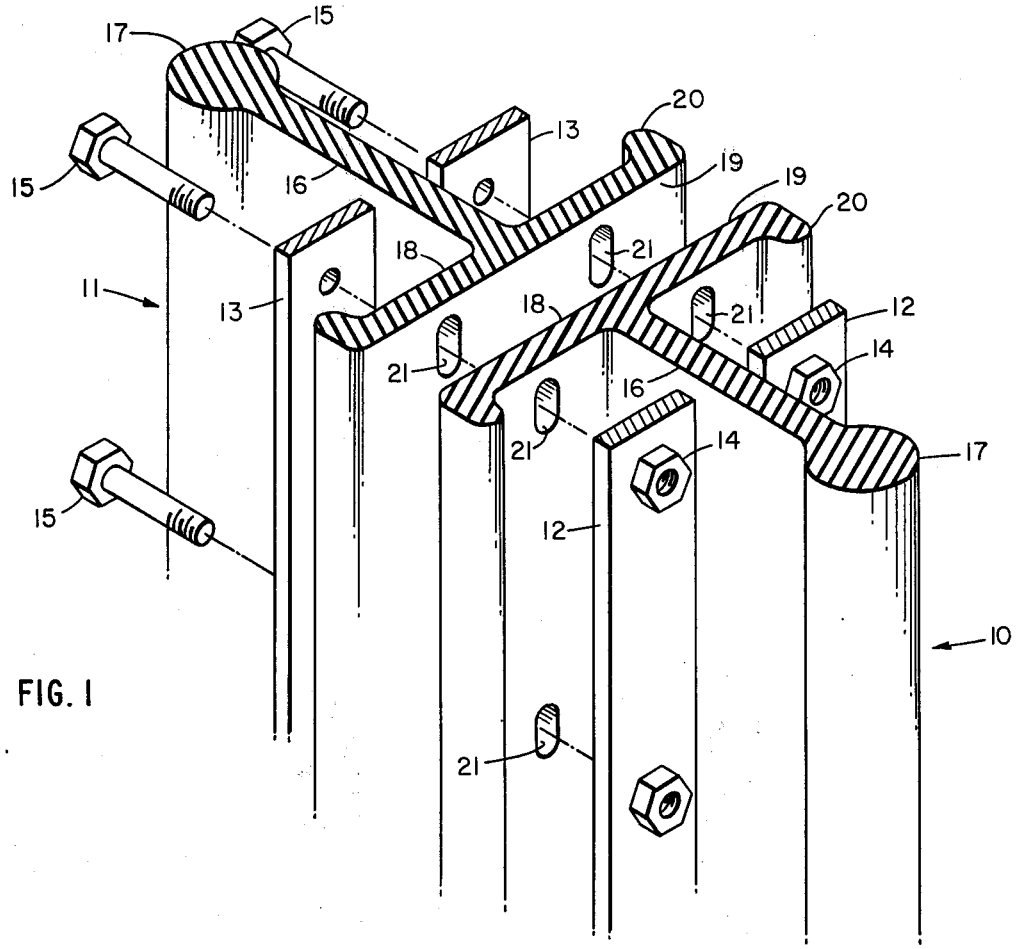
FIG. 1 is an exploded view in perspective of a preferred form of waterstop according to the invention and showing the transverse cross-section of the components.

Referring now to FIG. 1, the waterstop assembly, when viewed in transverse cross-section, comprises two T-shaped sealing strips 10 and 11, metal bars 12 and 13, hexagonal nuts 14 and bolts 15. Each T-shaped strips in turn consists essentially of a web-like portion 16 terminated at one end by a bulbous portion 17 and, at the other end, by a crossweb 18 and a substantially flat outer surface 19. Crossweb 18 may have thickened end portions 20, if desired. Crossweb 18 is perforated at regular intervals 21 on each side of web 16 and allow passage of bolts 15.

For fastening purposes, there are provided metal bars 12 and 13 which are preforated at regular intervals 21 to correspond with the perforation on crossweb 18. Bolts 15 are then passed through the perforations 21 and engaged into hexagonal nuts 14 which have been previously welded to bars 12.

Figure 2:
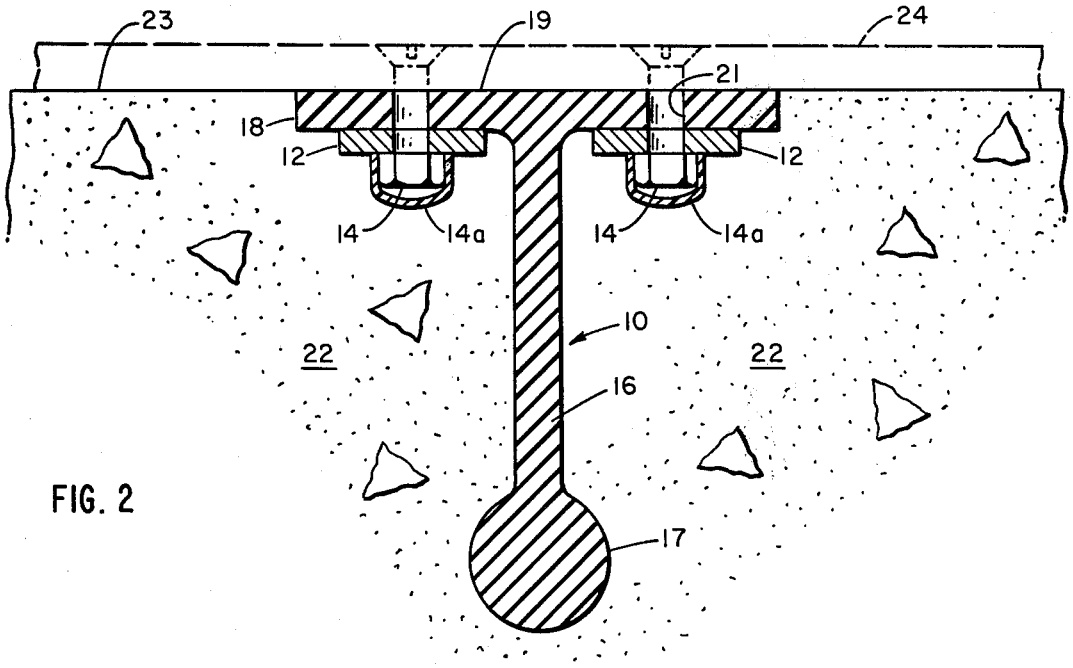
FIG. 2 shows a cross-section of a first pour of concrete in which one of the component strips of the waterstop has been embedded.

FIG. 2 shows, in a cross-section, a concrete mass 22 into which has been embedded one of the two T-shaped sealing strips 10 required to complete the waterstop of this invention. As may be seen the free surface 19 of crossweb 18 is flush with the outer edge 23 of the concrete mass and the strip is ready to be joined to the complementary strip by means of adhesive and bolts. A plastic cap **14*a* sits on hexagonal nuts 14 where is previously kept the liquid concrete from filling the holes through which bolts 15 will later be placed. The casting form 24, shown in outline form, has moved on to another position along the plane of the concrete surface 23**.

FIG. 3 shows, again in cross-section, the same concrete mass 22 and embedded strip 10, but in assembly with the second sealing strip 11 which in turn is embedded into adjacent concrete mass 25. Metal bars 12 and 13 are shown in final position and bolts 15 are locked into nuts 14 through holes 21. Area 26 between concrete face AA' and broken line BB' is filled with a light resilient material such as closed-cell polyethylene sheeting which is applied on the surface of concrete mass 22 at line AA' before concrete mass 25 is poured. A waterproof adhesive is applied between the two flat surfaces of strips 10 and 11 along line AA'.

Figure 3:
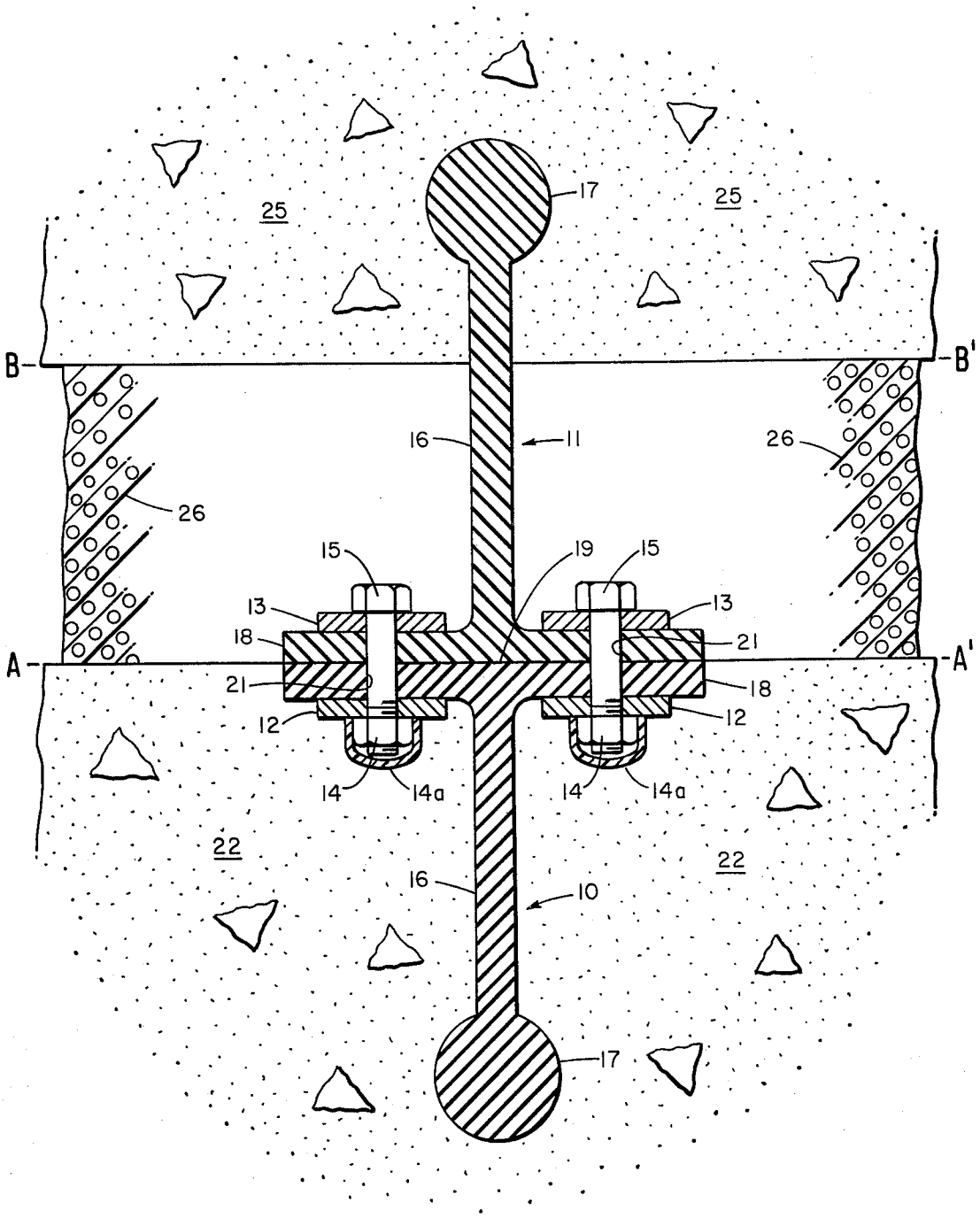
FIG. 3 shows a cross-section of a completely assembled waterstop installed between two adjacent masses of concrete.
Figure 4:
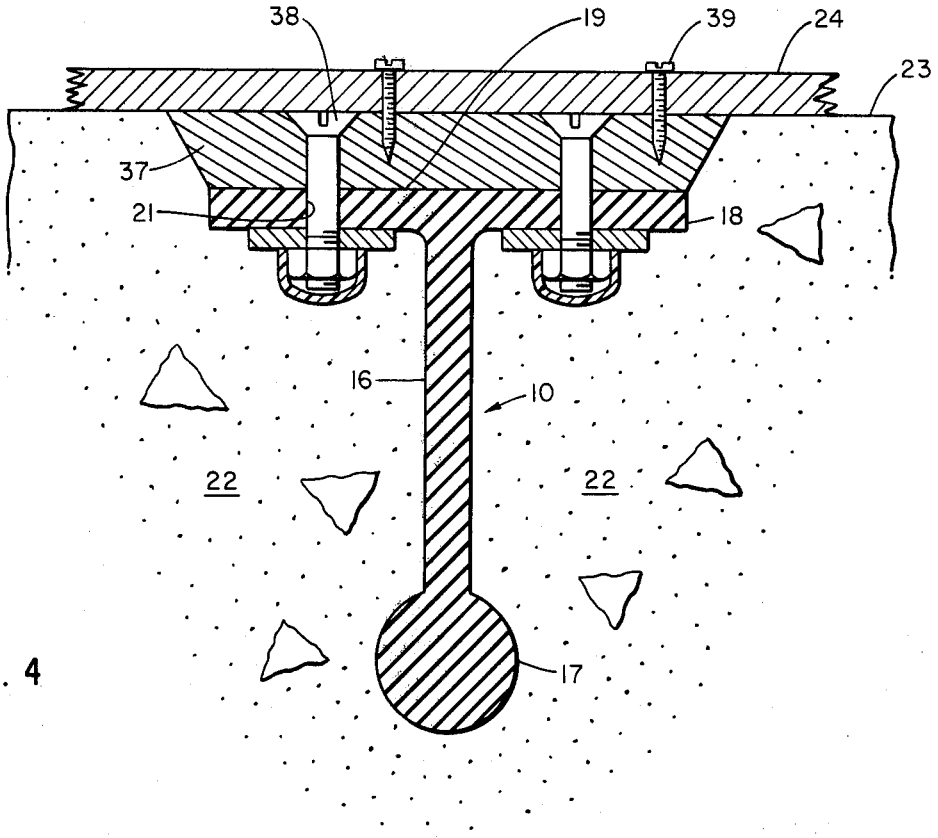
FIG. 4 shows in cross-section a first pour of concrete in which one of the component strips of the waterstop has been embedded in a recessed manner.

FIG. 4 shows in cross-section another method of embedding the first of the two opposed T-shaped sealing strips 10 in concrete mass 22. It will be seen that strip 10 is attached to form 37 by disposable countersunk bolts 38 placed in holes 21. Form 37 in turn is fastened to jump mold 24 by means of sheet metal screws 39. After the concrete mass 22 has been poured and has hardened, forms 24 and 37 are removed, leaving in wall 23 a depression having the trapezoidal cross-section of form 37. The second sealing strip 11 is then affixed, as shown in FIG. 3, with bars 13 and bolts 15 to complete the waterstop before the second pour of concrete 25. This type of installation is particularly suitable for resistance of seismic movements since bars 13 and the heads of bolts 15 are contained within the recess caused by the earlier presence of form 37, so that in case of extreme movement concrete masses 22 and 25 will hit each other, thus avoiding any damage that might be caused by the surface of mass 25 against bars 13.

For best resistance to seismic movement, the waterstop assembly described in the preceeding figures will approximate the following dimensions: (1) each of the two opposite sealing strips 10 and 11, is preferably embedded into its concrete mass to a depth of about 2 ½ inches, including a bulbous edge having a diameter of about one inch; (2) the flat parts of the central web and crossweb have a cross sectional thickness of about 3/8 inch; (3) the crosswebs have a cross-sectional length of about 5 inches and, finally, the total cross-sectional length of the central web of the post applied sealing strip 11 is about 5 inches, thus leaving free web span of about 3 ½ inches between the two concrete masses after proper embeddment. As to metal bars 12 and 13 they preferably measure 1 ½ inches × ¼inch in cross-section.

FIGS. 5 to 11 illustrates some of the various splicing sections and connectors which may be employed with the waterstop system of this invention.

Figure 5:
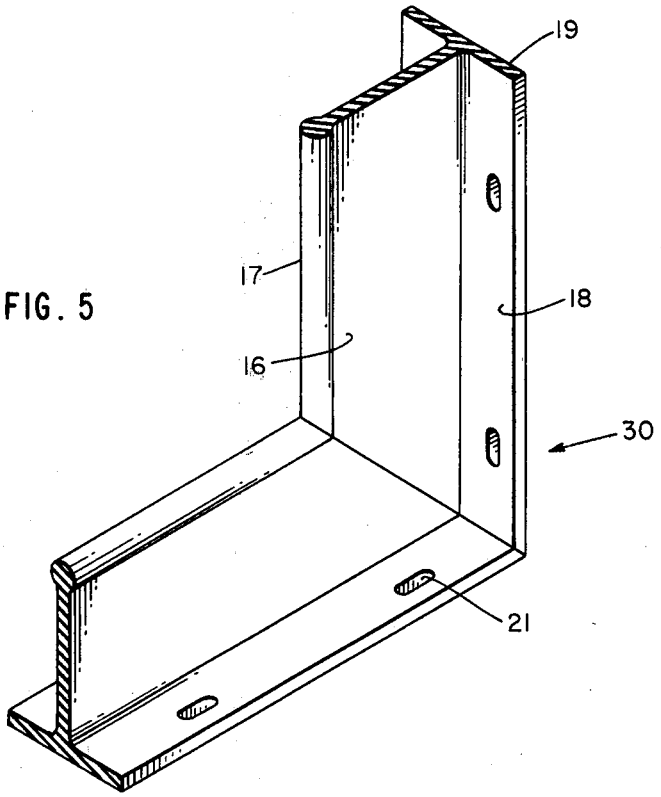
FIGS. 5 to 11 illustrate various types of splicing elements used to join waterstop extending in different directions.
Figure 6:
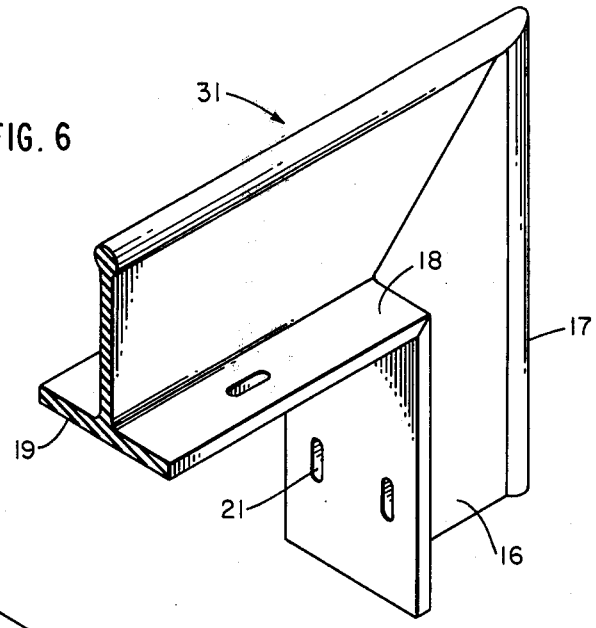

Specifically, FIGS. 5 and 6 show respectively internal 30 and external 31 corner splices that must be used when the direction of the waterstop changes by 90°, away from the surface of the first concrete pour.

Figure 7:
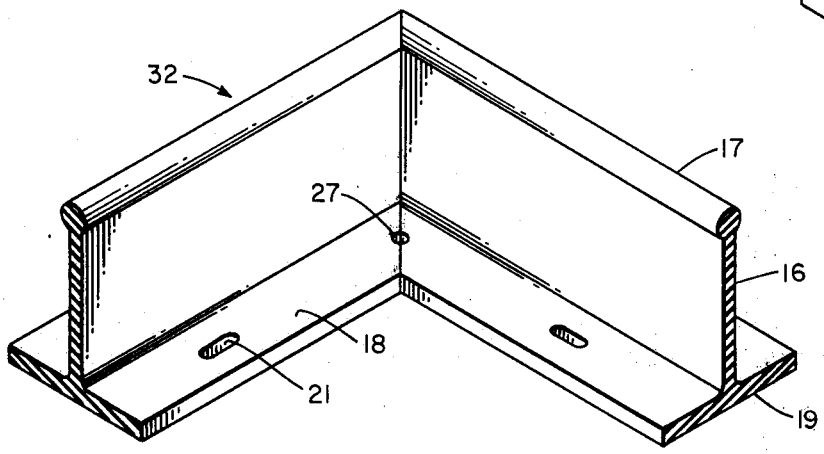
Figure 8:
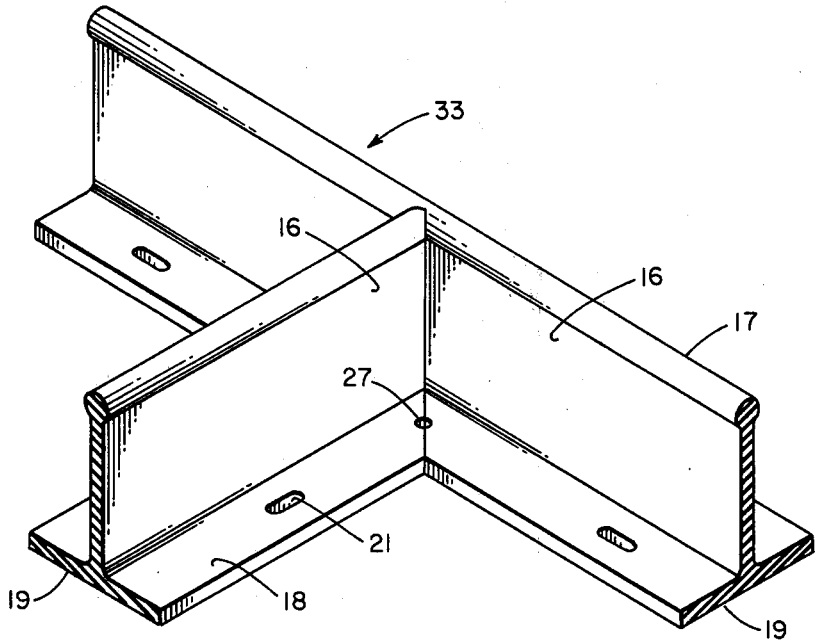
Figure 9:
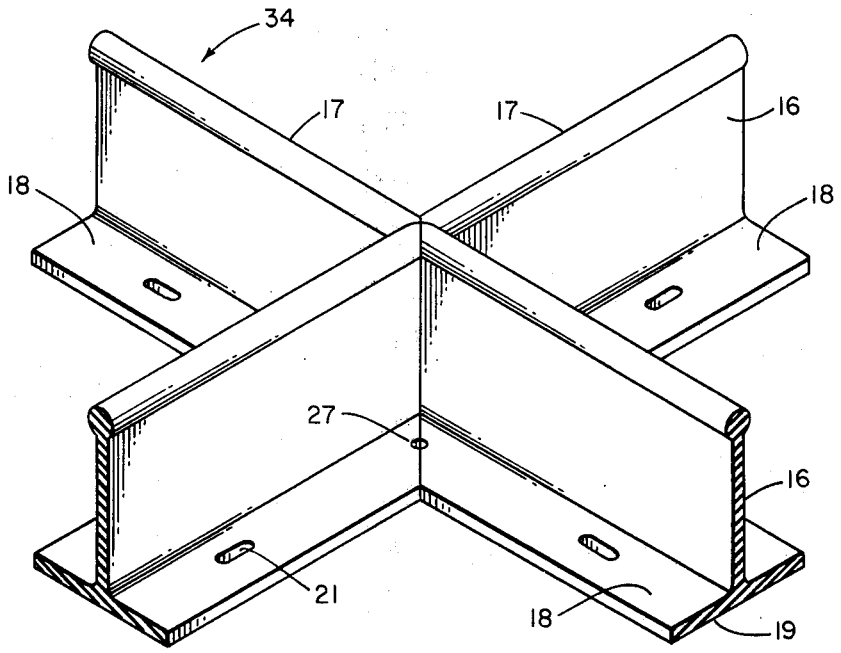

FIGS. 7, 8 and 9 show splices which must be used when the waterstop changes direction without leaving the plane of the surface of the first concrete pour in which the first strip is embedded. In these instances, the second splice strip, not shown, is substantially a mirror image of the one shown, except that generally web 16 of the splice member to be first embedded may be narrower than web 16 of the second, splice member to be embedded in the adjacent concrete pour. Thus, FIG. 7 shows a vertical corner splice 32, FIG. 8 shows a vertical T-splice 33, while FIG. 9 shows a vertical cross-splice 34. These splices may be provided with additional performations 27 for more secure fastening at each location where the change of direction occurs.

Figure 10:
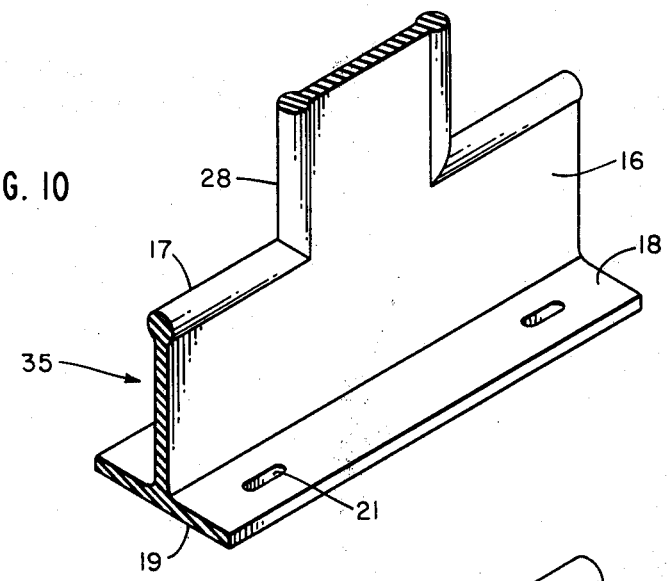

In FIG. 10, there is illustrated a transition splicing unit 35 which would connect a sealing strip of the present invention to a conventional dumbbell-shaped sealing strip 28.

Figure 11:
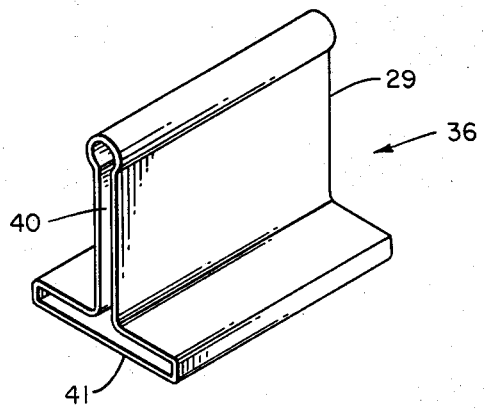

FIG. 11, shows a splicing boot 36, which is a tridimensional adaption of the splicing sleeve disclosed in U.S. Pat. No. 2,867,160 used for splicing conventional dumbbell shaped strips. In use, one end 40 of this boot 36 is slipped over the end of a tridimensional strip or splice of the type already described and the other end 29 is slipped over one end of the other tridimensional strip that is to be joined to the first strip or splice. The contacting surfaces within the splicing boots are coated with a fluid impervious adhesive material that will form a strong bond at ordinary ambient temperature, for example an air dry type rubber cement containing rubber dissolved in a volatile liquid. Compressible gasketing material, such as polyurethane or styrene-butadiene rubber sponge is preferably inserted on the underside of the crossweb of the strips to fill the voids created at the points where the splicing boot begins and ends.

It will be appreciated by the man skilled in the art that the actual size and proportions of the various parts of the waterstop and splices described, as well as the materials from which said parts are made, will vary somewhat depending upon the type of concrete structure in which they are to be used and the environment in which they must perform. In other words, factors such as temperature, moisture, radiation, corrosive substances and actual or potential movement of the finished structure will dictate the actual specifications that shall be required for any given application of the waterstop of this invention. To illustrate how these factors bear on a specific application, it can be pointed out that waterstop material to be used in containment buildings of nuclear reactor must be radiation resistant, thus exluding polychloroprene and favoring styrene-butadiene rubber. Furthermore, in such a demanding application as that just mentioned, the waterstop members must be of sufficient dimensions and weight to resist pronounced seismic movement.

Having described this invention in terms of the embodiments shown in the drawings, it remains understood that said invention is not limited by any of the details of description, unless otherwise specified, but rather to be construed broadly within the spirit and the scope of the following claims.

What is claimed is:

1. A waterstop member in the form of a solid strip made of resilient elastomeric material for use in a post-applied waterstop assembly employed to seal the joint between two concrete bodies, said waterstop comprising in transverse cross-section; (a) a central web to be anchored in said concrete and joined by one of its two edges to the median of (b) a crossweb, thereby forming a substantially T-shaped cross-section, the said central web (a) constituting the lower, downwardly-extending leg of said T, the said crossweb (b) constituting the upper, horizontally-extending leg of said T, said central web further in cross section having thickened areas at locations generally removed from its edge joined to said crossweb, which thickened areas resist withdrawal of said central web from said concrete; said crossweb having perforations preformed therethrough along the length thereof, said perforations being regularly distributed on each side of the central web, said crossweb further having a substantially flat surface remote from its surface to which the said central web is joined for engaging in sealing relationship with another said substantially flat surface of a second like waterstop member.

2. The waterstop member of claim 1 wherein the edge of the central web that is not joined to the crossweb is thickened in a bulb-shaped manner.

3. The waterstop member of claim 1 wherein the thickened areas of the central web are in the form of ribs running longitudinally on both its surfaces.

4. The waterstop member of claim 1 wherein the resilient elastomeric material is a styrene-butadiene rubber.

5. A waterstop member of T-shaped cross-section as in claim 1 wherein there is at least one change of direction of intersection along the longitudinal axis of the waterstop member.

6. A method of erecting a waterstop between two adjacent consecutively poured first and second concrete masses, said method comprising the steps of:

a. providing a first waterstop member according to claim 1 and further a first pair of two longitudinally-extending metal bars, each of said bars being provided with a number of preformed perforations therethrough and a number of superposed attached nuts on one surface of the bar concentric with the said perforations, said perforations in said bars being distributed along the central longitudinal axes of the bars in a pattern matching that of the perforations along the longitudinal length of the crossweb of said first waterstop member;

b. positioning the surfaces of said metal bars opposite said superposed nuts against the surface of said crossweb of said first waterstop member joined to said central web in a manner such that the said bars are separated by said central web, and in a manner further such that the perforations through said crossweb are aligned in bolt-receiving arrangement with the perforations through said bars and with said nuts;

c. pouring a first mass of concrete about said central web and said metal bars yet leaving said substantially flat surface of said crossweb exposed and substantially parallel to the surface of said first concrete mass;

d. providing a second waterstop member according to claim 1 and two additional perforated metal bars, the perforations through said second waterstop member and said additional bars having the same pattern as said first sealing strip and metal bars aligned therewith;

e. positioning the substantially flat surface of the crossweb of said second waterstop member against the said exposed surface of said first waterstop member such that the perforations through the crosswebs of said first and second waterstop members are aligned;

f. placing said additional two metal bars against the exposed surface of the crossweb of said second waterstop member such that each of the bars is separated by the central web of said second waterstop member, and aligning the perforations through the metal bars with the perforations through said crossweb;

g. passing bolts of suitable length and thread through said second metal bars, said waterstop members and said first pair of metal bars are superposed nuts in order to secure said first and second waterstop members together; and h. thereafter anchoring the said central web of said second waterstop member in said second concrete mass.

7. The method of claim 6 wherein all the metal components are made of stainless steel.

8. A method of erecting a waterstop between two adjacent concrete masses while casting said concrete within removable forms, said method comprising the steps of:

a. providing a first waterstop member according to claim 1 and placing one each of a first pair of two metal bars against the surface of the crossweb of said member joined to the central web and on opposite side of said central web, said bars being longitudinally-extending with said waterstop member and having preformed perforations therethrough of the same pattern as the perforations through said member so that after placement the perforations of said bars are aligned with the perforations through said member;

b. fastening said waterstop and said placed metal bars to the inner surface of a form for said concrete in a manner such that the central web of said waterstop member projects into the interior of the compartment defined by the form, said fastening being accomplished by passing removable bolts through said form, said waterstop member, said bars and into a number of nuts superposed on the surfaces of the bars remote from said member;

c. pouring concrete to fill the compartment defined by the forms in a manner such that the substantially flat surface of the crossweb of the said waterstop member will remain exposed after removal of the forms;

d. removing said forms at the rate required by removing said bolts from said perforations through said first strip and bars;

e. providing a second waterstop member and a second pair of corresponding-perforated metal bars positioned as in step (a), the perforations through said second member and second pair of bars having the same pattern as the perforations through said first member and said first pair of bars;

f. placing the substantially flat surface of said second waterstop member against the exposed substantially flat surface of the crossweb of said first waterstop member and securing it thereto by passing bolts of suitable length and thread through said second pair of bars, said first and second waterstop members, and into said nuts; and g. thereafter pouring a second mass of adjacent concrete in a manner such that the central web of said second waterstop member is anchored in said second concrete mass.

9. A method according to claim 8 wherein the substantially flat surface of the first waterstop member is first fastened to a removable recess-forming member by way of said removable bolts passing through said member and said bars, which removable recess-forming member is in turn removably fastened to said form, and said concrete is poured about said central web and said bars and coplanar with the surface of said recess-forming member adjacent said form in order that said exposed surface of said joint forming member is recessed into a face of said concrete when said forming member is subsequently removed.

10. A method according to claim 8 wherein a layer of light resilient material is provided for between the two concrete masses before the said second mass of concrete is placed.

11. A method according to claim 8 wherein said nuts are provided with plastic caps to prevent said poured concrete from entering therein.

12. A method according to claim 10 wherein said resilient material is closed-cell polyethylene.

* * * * *